United States Patent [19]

Bats

[11] 3,939,073

[45] Feb. 17, 1976

[54] APPARATUS FOR DEODORIZING LIQUIDS

[76] Inventor: Jules Bats, Place de la Gare, 40 - Mugron (Landes), France

[22] Filed: Nov. 26, 1974

[21] Appl. No.: 527,275

[52] U.S. Cl. ..... 210/152; 21/55; 21/61; 21/DIG. 1; 210/198 R; 239/399; 239/431; 239/432; 259/7

[51] Int. Cl.[2]..... B01F 7/02; B05B 7/06; B01F 7/08

[58] Field of Search ..... 21/61, 55; 210/21, 511, 210/198; 239/399, 430–432; 259/4, 7–10, 18, 22–26

[56] References Cited

UNITED STATES PATENTS

| | | | |
|---|---|---|---|
| 2,802,648 | 8/1957 | Christensen et al. | 259/18 |
| 3,297,305 | 1/1967 | Walden | 259/4 |
| 3,321,283 | 5/1967 | Ewald | 259/7 |
| 3,428,413 | 2/1969 | Froelich | 21/61 |
| 3,666,663 | 5/1972 | Walker | 259/7 |
| 3,675,901 | 7/1972 | Rion | 259/4 |
| 3,785,779 | 1/1974 | Li et al. | 259/4 |

*Primary Examiner*—Joseph Scovronek
*Assistant Examiner*—Dale Lovercheck
*Attorney, Agent, or Firm*—Young & Thompson

[57] ABSTRACT

Apparatus for admixing a deodorizing liquid with a bad smelling liquid, comprises a hollow body in the form of a Y lying on its side in a vertical plane, the lower leg of the Y discharging the admixed liquids and the upper leg of the Y supporting and housing conduits for supplying the deodorizing liquid lengthwise of the body to dispensers therefor located adjacent the lower end of the body. A fixed shaft within the body has partitions secured thereto that are comprised by a plurality of blades and are oppositely inclined for initially mixing the two liquids. Above these partitions, a rotary helicoidal turbine is rotated by a turbine shaft that extends through the upper leg of the Y.

8 Claims, 8 Drawing Figures

FIG. 1
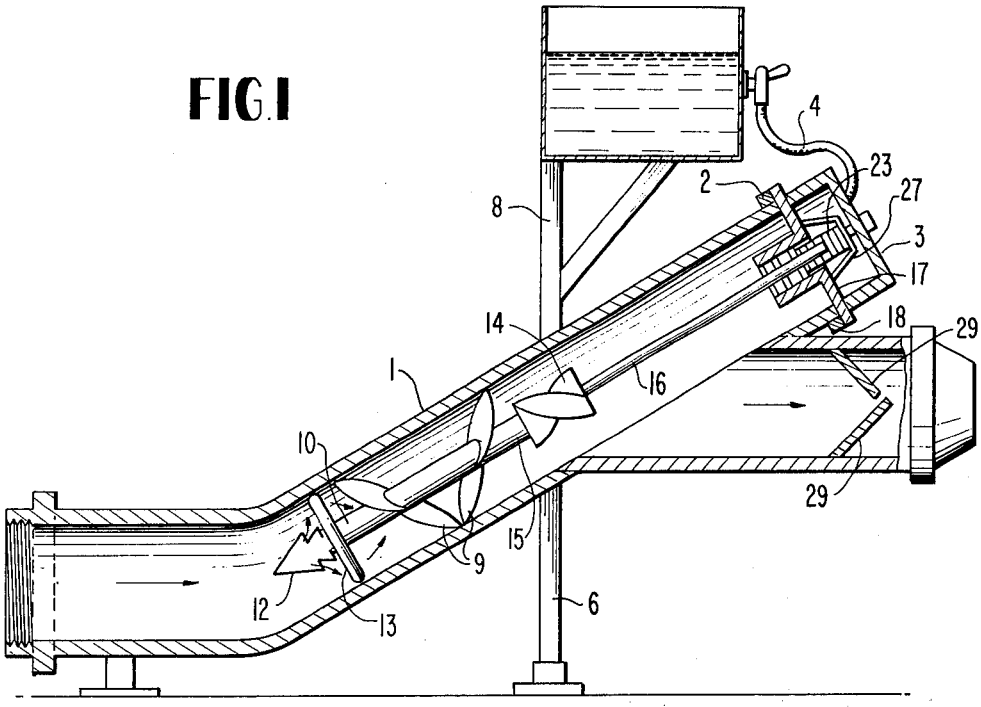
FIG. 2
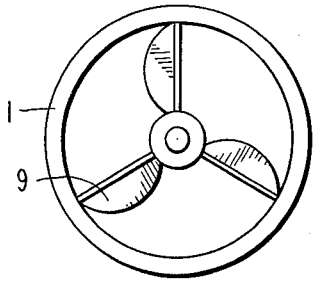
FIG. 3
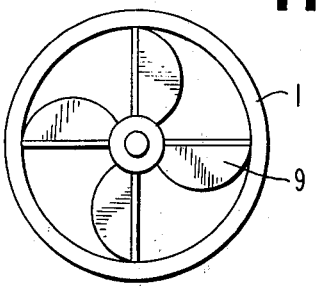
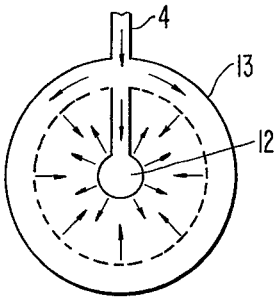
FIG. 4a
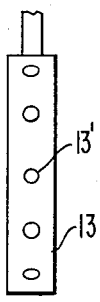
FIG. 4b

APPARATUS FOR DEODORIZING LIQUIDS

The present invention relates to apparatus for preventing the pollution of the atmosphere by bad odors emitted from various bad smelling liquids.

The present invention has for its object the provision of apparatus for admixing a deodorizing liquid with a bad smelling liquid in a homogeneous manner. The bad smelling liquid may be pastey or viscous or may have suspended solid or semi-solid bodies, the present invention providing for a constant ratio of addition of the deodorizing liquid to the bad smelling liquid.

Other objects, features and advantages of the present invention will become apparent from a consideration of the following description, taken in connection with the accompanying drawings, in which:

FIG. 1 is a cross-sectional elevational view of apparatus according to the present invention;

FIG. 2 is an enlarged cross-sectional view showing a fixed mixing partition comprised by three inclined vanes;

FIG. 3 is a view similar to FIG. 2, but showing a fixed mixing partition comprised by four inclined vanes;

Figure 5:
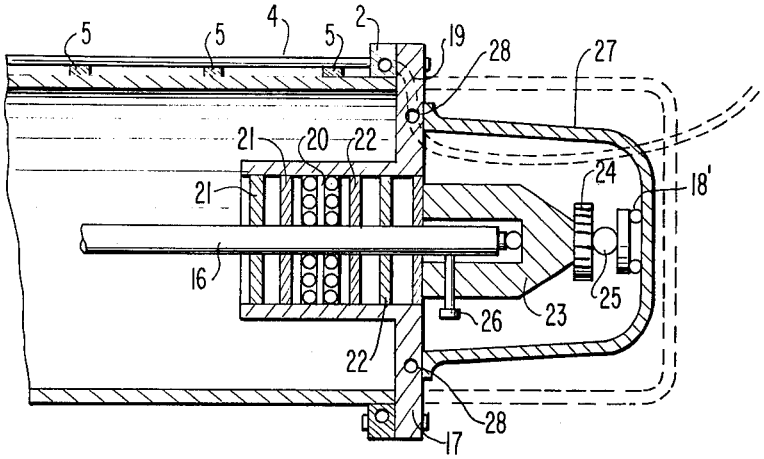
Figure 6:
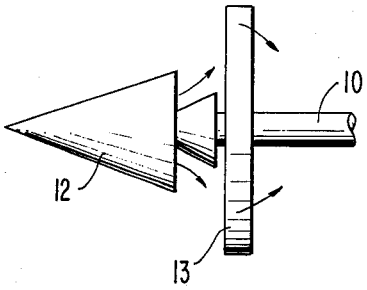
Figure 7:
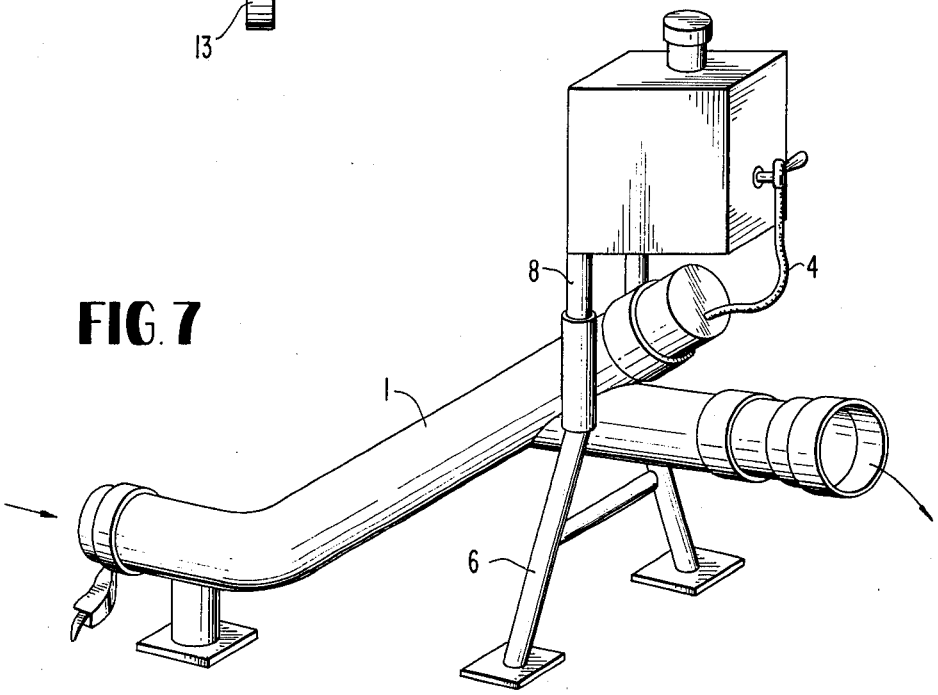

FIGS. 4*a* and 4*b* are frontal and edge elevational views, respectively, of the means for initially supplying the deodorizing liquid to the bad smelling liquid;

FIG. 5 is an enlarged fragmentary cross-sectional view of the upper end of the apparatus with the protective cap shown in phantom lines;

FIG. 6 is an enlarged fragmentary elevational view of the diffuser for the deodorizing liquid; and FIG. 7 is a perspective view of the apparatus of the present invention.

Referring now to the drawings in greater detail, there is shown apparatus according to the present invention, comprising a cylindrical conduit body 1 of generally Y-shaped configuration at whose upper end is a flange 2 that is pierced by holes. A cap 3 covers the upper end. Tubing 4 of plastic material or glass extends parallel to the body of the device and is fixed thereto by supports 5 and carries the deodorizing liquid from the doser to the diffusers.

A two-legged mobile support 6 supports the upper end of the device while a shorter rear leg supports the rear of the device.

In the interior of the body 1, disposed above the place where the deodorizing liquid is injected, are two mixing partitions 9 which are oppositely inclined and comprised by any desired number of inclined blades and are fixed on the one hand to a fixed central support 10 and are fixed on the other hand to the interior wall of the body 1. The partitions 9 serve not only as mixing partitions but also as the support for central member 10.

At the lower end of support 10 there is mounted the central diffuser 12 with its multiple outlets.

Also carried by the support 10 is a circular chamber 13 provided with multiple outlets.

The two diffusers 12 and 13 assure the uniformity of dilution of the added liquid fed by the pipe 4.

The upper end of the central support 10 is provided with a machined member that receives the helicoidal turbine 14 that has a bearing ring at 15 of plastic that is lubricated by the carrier liquid. This turbine is provided with multiple blades of suitable dimensions and inclination.

The shaft 16 which prolongs the turbine 14 passes through the upper plate 17 which closes the body of the device in cooperation with the flange 2 and is secured by appropriate fasteners thereto. An oblique hole 19 traverses the plate to permit the passage of the conduit 4 carrying the additive liquid from the doser to the diffusers.

At the center of the plate is disposed a roller bearing 20 with a double ball race which receives the axle of the turbine. The bearing cage is sufficiently large to receive two lower sealing rings 21 and two upper sealing rings 22 so as to permit the device to operate under either positive or negative pressure.

The outer end of the turbine axle is sufficiently long to receive a cap 23 which carries a drive motor pinion 24 whose bearing ball 25 prevents any lateral play. Pinion 24 is driven by any appropriate motor means (not shown).

Cap 23 is provided with a clamping screw 26 and with a slot that receives a releasable lock preventing the unscrewing thereof.

A stirrup 27 fixed to plate 17 by gudgeons 28 carries the doser. A flat-headed regulating screw bears against the ball 25 and is secured in a screw-threaded hole in the stirrup and is blocked by a counter screw.

A clamping collar and its stirrup fixed by two screws permits connecting the tubing 4 of the additive liquid leaving the doser toward the diffusers by means of the tube 4.

The doser fitting which passes through the cap 3 is provided so as to ensure its fluidtightness with a sealing ring 18' which bears on the one hand on the fixation screw of the doser to the stirrup, and on the other hand on the interior of the cap.

The cap 3 covering the doser and the assembly of its securement accessories is secured to the plate by three female gudgeons. The fluidtightness between the plate and the cap is assured by a sealing ring.

It will of course be understood that the liquid flowing from left to right at the lower left of FIG. 1 passes the diffusers 12 and 13, flowing about the diffusers 12 and 13 and thus receives a charge of deodorizing liquid, e.g. formaldehyde which proceeds from the storage therefor through the conduit 4. The liquid is then agitated and admixed by passing the partitions 9 with their oppositely inclined blades and is further mixed by the turbine 14 which can be rotated by the liquid or power driven through the pinion 24, the thoroughly mixed liquids then proceeding through the lower leg of the Y-shaped apparatus past the final deflectors and agitators 29 to an appropriate discharge.

From a consideration of the foregoing disclosure, thereof, it will be evident that all of the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

Having described may invention, I claim:

1. Apparatus for admixing a deodorizing liquid with a bad smelling liquid, comprising a generally Y-shaped hollow body comprised by a base having an upper and a lower end, a first leg and a second leg, and said legs meeting the base at an angle to each other, means supporting the Y-shaped body in an inclined position with the base and the first leg at an acute angle to a horizontal and the second leg below said first leg, the base and the legs intersecting in a vertical plane, means for introducing a deodorizing liquid into the lower end of the base, fixed mixing means within the base above said introducing means for admixing the deodorizing liquid and the bad smelling liquid, rotatable mixing means above the fixed mixing means in said body, an inclined shaft having a lower and an upper end extending coaxially through said first leg for rotating said rotatable mixing means, said fixed mixing means supporting the lower end of said shaft, and means at the upper end of said shaft for rotating said shaft.

2. Apparatus as claimed in claim 1, said rotatable mixing means comprising a helicoidal turbine.

3. Apparatus as claimed in claim 1, and further comprising oppositely inclined baffles in said second leg for further mixing said bad smelling liquid and said deodorizing liquid.

4. Apparatus as claimed in claim 1, said legs being at an acute angle to each other and said second leg being horizontal.

5. Apparatus as claimed in claim 1, and means supporting the upper end of said inclined shaft for rotation in said first leg, said supporting means comprising a roller bearing with a double ball race that rotatably receives and supports the upper end of said shaft, two sealing rings carried by said first leg and sealing against said shaft on one side of said roller bearing, and two sealing rings carried by said one leg and sealing against said shaft on the other side of said roller bearing so as to permit said apparatus to operate under either positive or negative pressure.

6. Apparatus as claimed in claim 1, said fixed mixing means comprising a fixed shaft, and spaced inclined blades secured to said fixed shaft and to the interior of said base.

7. Apparatus as claimed in claim 6, said inclined blades being oppositely inclined to each other.

8. Apparatus as claimed in claim 6, said introducing means comprising a chamber with multiple outlets secured to the lower end of said fixed shaft.

* * * * *